US007419280B2

(12) United States Patent
Chou

(10) Patent No.: US 7,419,280 B2
(45) Date of Patent: Sep. 2, 2008

(54) ILLUMINATION ASSEMBLY

(75) Inventor: Wei-Jen Chou, Miao Li County (TW)

(73) Assignee: Coretronic Corporation, Chu Nan, Miao Li County (TW)

( * ) Notice: Subject to any disclaimer, the term of this patent is extended or adjusted under 35 U.S.C. 154(b) by 329 days.

(21) Appl. No.: 11/397,205

(22) Filed: Apr. 4, 2006

(65) Prior Publication Data

US 2006/0232525 A1 Oct. 19, 2006

(30) Foreign Application Priority Data

Apr. 19, 2005 (TW) ..... 94112379 A

(51) Int. Cl.
*F21V 9/00* (2006.01)

(52) U.S. Cl. ..... 362/231; 362/800

(58) Field of Classification Search ..... 362/230, 362/231, 800, 612, 613, 555, 559–561, 545, 362/252; 345/82, 83; 313/498, 500
See application file for complete search history.

(56) References Cited

U.S. PATENT DOCUMENTS 6,236,382 B1 5/2001 Kawakami et al. ..... 345/83
6,857,767 B2 * 2/2005 Matsui et al. ..... 362/373
6,923,548 B2 * 8/2005 Lim ..... 362/612
6,964,489 B2 * 11/2005 Blume et al. ..... 362/27

FOREIGN PATENT DOCUMENTS

JP 10-173242 6/1998
JP 10-319871 12/1998 ..... 9/33

* cited by examiner

*Primary Examiner*—Bao Q Truong
(74) *Attorney, Agent, or Firm*—Ohlandt, Greeley, Ruggiero & Perle L.L.P.

(57) ABSTRACT

An illumination assembly includes a first diode row having first and second multi-chip LED units, and a second diode row having third and fourth multi-chip LED units. The first through fourth multi-chip LED units each includes red, green, and blue LEDs. Light of the red, green, and blue LEDs of the first through fourth multi-chip LED units has a respective primary emission direction (PED). The PEDs of same colored ones of the LEDs of the first and second multi-chip LED units are oriented along one direction. The PEDs of the remaining two LEDs of the first and second multi-chip LED units are oriented in opposite directions from each other. The PEDs of the LEDs of the third and fourth multi-chip LED units are oriented in opposite directions as compared to those of the LEDs of the first and second multi-chip LED units, respectively.

17 Claims, 4 Drawing Sheets

ILLUMINATION ASSEMBLY

CROSS-REFERENCE TO RELATED APPLICATION

This application claims priority of Taiwanese Application No. 094112379, filed on Apr. 19, 2005.

BACKGROUND OF THE INVENTION

1. Field of the Invention

The present invention relates to an illumination assembly, more particularly to an illumination assembly having a multi-chip light emitting diode (LED) array.

2. Description of the Related Art

White light may be obtained using LEDs by combining a LED with other materials, or by combining a plurality of differently colored LEDs. As an example of the former method, a blue LED is used in conjunction with a phosphor powder that emits a yellow light when excited. The yellow light emitted by the phosphor powder mixes with the blue light of the LED that has not been absorbed by the phosphor powder to generate white light. In the latter method, an additive color technique is employed by using differently colored LEDs in combination, thus obtaining white light. That is, white light is obtained by combining light irradiated from red, green, and blue LEDs. Two different conventional configurations employing this latter approach are described below.

FIG. 1 schematically shows a conventional LED cluster arrangement. LEDs are arranged in a matrix of a plurality of RGB (or RGGB) clusters 10 to thereby utilize the additive color phenomenon to obtain white light. In this configuration, if it is desired to obtain a brightness roughly equal to that obtained using, for example, a cold cathode fluorescent lamp, a large number of the LEDs need to be used, thus raising costs. Further, if a small number of the LEDs in the cluster arrangement malfunction, the purity of the white light is reduced, and other non-white colors may become visible. In addition, with this configuration, a color combination distance (i.e., a minimum distance from the LEDs at which the additive color phenomenon takes effect) is approximately 30 mm, which may be considered excessive for some applications.

FIG. 2 is a perspective view of a conventional multi-chip LED unit. In the particular configuration shown in the drawing, three discrete red, green, and blue LEDs 11 are integrated in a single package. The LEDs 11 realize a Lambertian light distribution so that white light is obtained by combining light of the LEDs 11. A cylindrical transparent lens (not shown) is typically used in the multi-chip LED unit to enhance light-emission efficiency. However, since it is not possible for all three of the LEDs 11 to be positioned on a center axis of the transparent lens, the light emitted from each of the LEDs 11 is skewed in three different directions and is not projected vertically. As a result, the color combination distance is increased, and the additive color effect is degraded.

SUMMARY OF THE INVENTION

Therefore, the object of this invention is to provide an illumination assembly having a multi-chip light emitting diode (LED) array in which light emitted from LEDs in the array are effectively combined, thereby obtaining a high degree of purity for white light generated by the array while achieving a minimal color combination distance.

The illumination assembly of this invention comprises a base plate, a first diode row including a first multi-chip LED unit, and a second multi-chip LED unit each mounted on the base plate. The first multi-chip LED unit includes a red LED, a green LED, and a blue LED, and further includes a first transparent lens. The second multi-chip LED unit includes a red LED, a green LED, and a blue LED, and further includes a second transparent lens. Emitted light of each of the red, green, and blue LEDs of the first and second multi-chip LED units has a respective primary emission direction along which a majority of the emitted light is projected through a corresponding one of the first and second transparent lenses.

The primary emission directions of one of the red, green, and blue LEDs of the first multi-chip LED unit and of the same one of the red, green, and blue LEDs of the second multi-chip LED unit are oriented along a first direction in the first diode row.

The primary emission directions of the remaining two of the red, green, and blue LEDs of the first multi-chip LED unit are in a reversed order of the primary emission directions of the same remaining two of the red, green, and blue LEDs of the second multi-chip LED unit in the first diode row.

The multi-chip LED array further comprises a second diode row including a third multi-chip LED unit and a fourth multi-chip LED unit. Each of the third and fourth multi-chip LED unit is mounted on the base plate. The third multi-chip LED unit includes a red LED, a green LED, and a blue LED, and further includes a third transparent lens. The fourth multi-chip LED unit includes a red LED, a green LED, and a blue LED, and further includes a fourth transparent lens. Emitted light of each of the red, green, and blue LEDs of the third and fourth multi-chip LED units has a respective primary emission direction along which a majority of the emitted light is projected through a corresponding one of the third and fourth transparent lenses.

The primary emission directions of the red, green, and blue LEDs of the third multi-chip LED unit in the second diode row are oriented in opposite directions respectively as compared to the primary emission directions of the red, green, and blue LEDs of the first multi-chip LED unit in the first diode row.

The primary emission directions of the red, green, and blue LEDs of the fourth multi-chip LED unit in the second diode row are oriented in opposite directions respectively as compared to the primary emission directions of the red, green, and blue LEDs of the second multi-chip LED unit in the first diode row.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
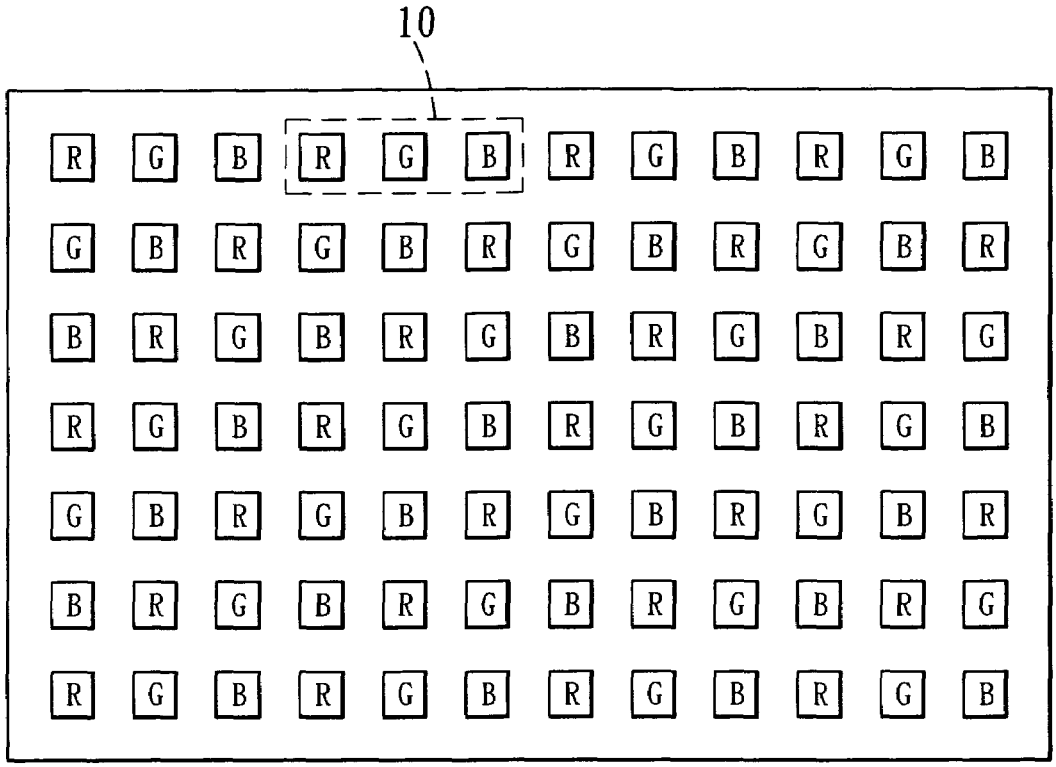
FIG. 1 PRIOR ART
FIG. 1 is a schematic view of a conventional light emitting diode (LED) cluster arrangement.
Figure 2:
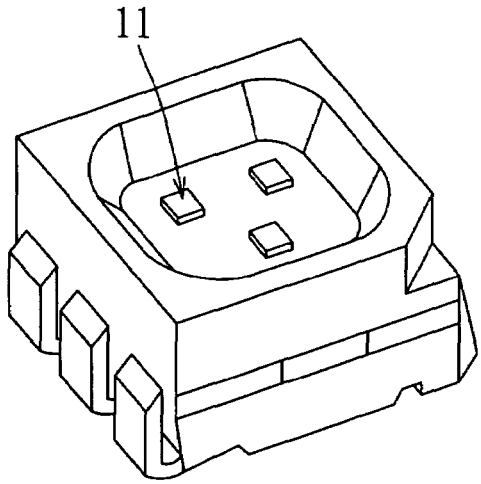
FIG. 2 PRIOR ART
FIG. 2 is a perspective view of a conventional multi-chip LED unit.
Figure 3:
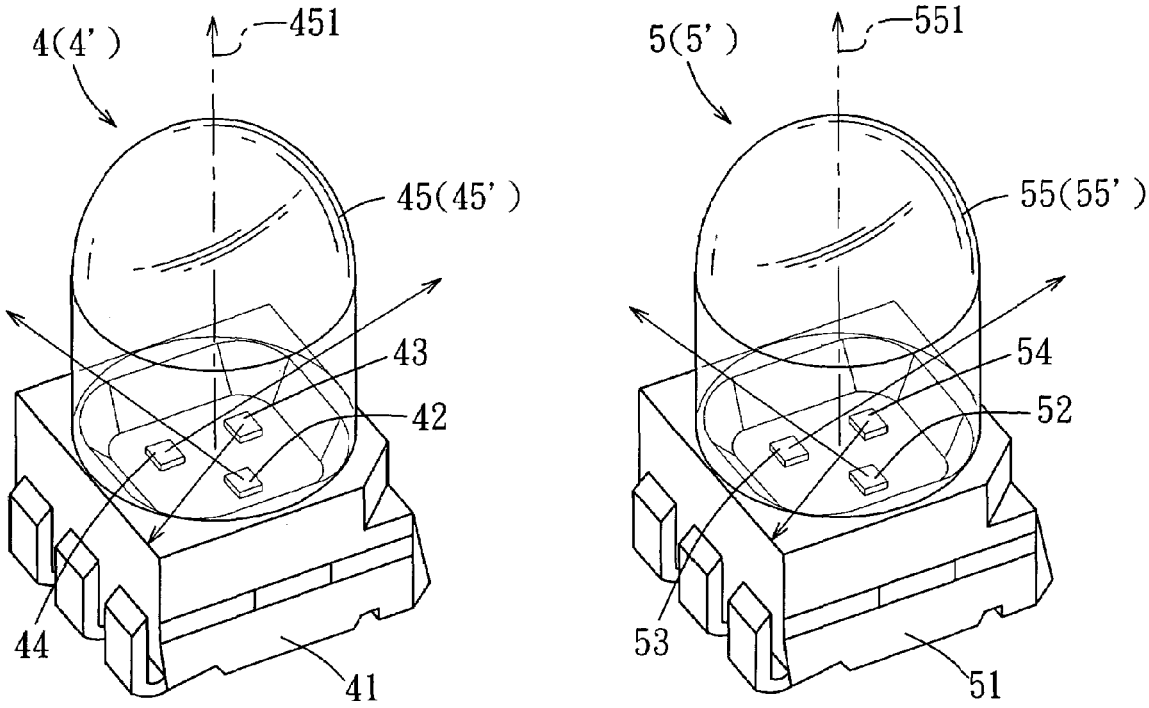
FIG. 3 is a perspective view of an illumination assembly according to a preferred embodiment of the present invention.
Figure 4:
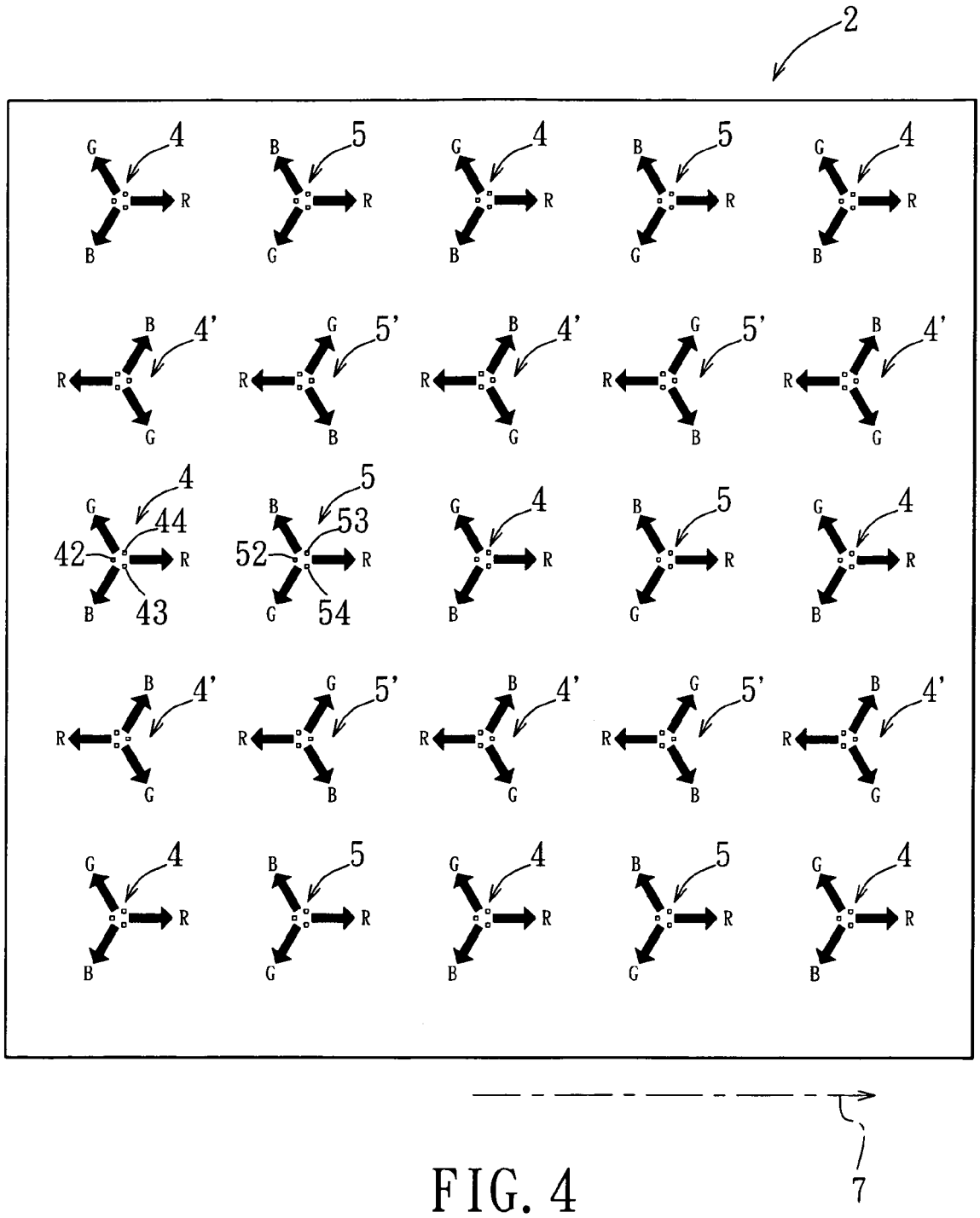
FIG. 4 is a schematic plan view of an illumination assembly according to a preferred embodiment of the present invention.
Figure 5:
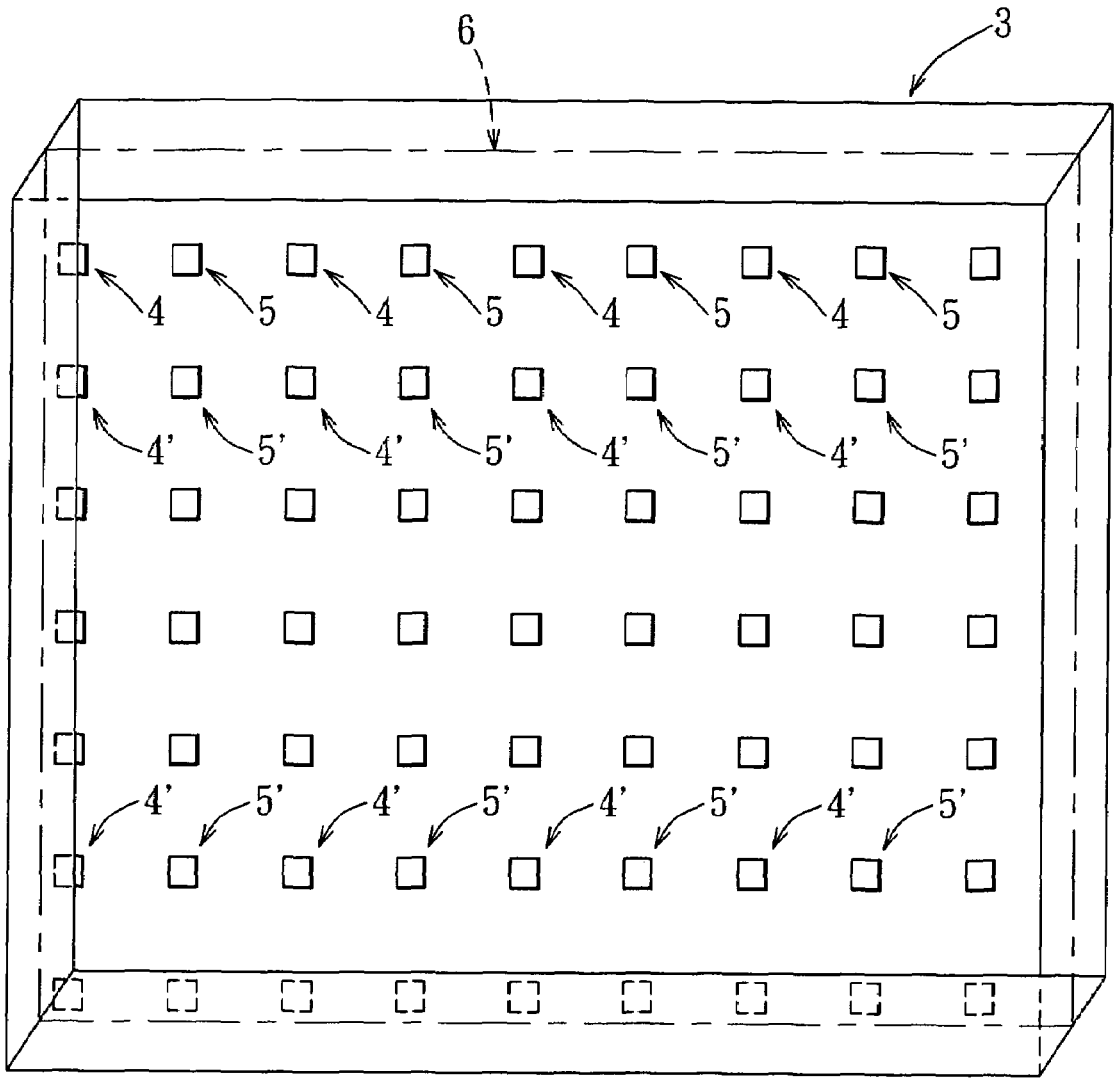
FIG. 5 is a schematic perspective view of the preferred embodiment, illustrating the multi-chip LED array mounted in a housing.

Referring to FIGS. 3, 4, and 5, an illumination assembly according to a preferred embodiment of the present invention includes a base plate 2, a housing 3, multi-chip light emitting diode (LED) array, and a diffusion sheet 6.

The multi-chip LED array includes first through fourth multi-chip LED units 4, 4', 5, 5' and includes a first diode row. The first diode row are composed by the first multi-chip LED unit 4 and the second multi-chip LED unit 5, which are mounted on the base plate 2. The first multi-chip LED unit 4 includes a red LED 42, a green LED 43, and a blue LED 44, as well as a first transparent lens 45. The second multi-chip LED unit 5 includes a red LED 52, a green LED 53, and a blue LED 54, as well as a second transparent lens 55. Emitted light of each of the red, green, and blue LEDs 42-44 and 52-54 of the first and second multi-chip LED units 4, 5 have a respective primary emission direction along which a majority of the emitted light is projected through a corresponding one of the first and second transparent lenses 45, 55.

The primary emission directions of one of the red, green, and blue LEDs 42-44 of the first multi-chip LED unit 4 and the primary emission directions of one of the red, green, and blue LEDs 52-54 of the second multi-chip LED unit 5 are oriented along a first direction 7 in the first diode row. Furthermore, the primary emission directions of the remaining two of the red, green, and blue LEDs 42-44 of the first multi-chip LED unit 4 are in a reversed order of the primary emission directions of the same remaining two of the red, green, and blue LEDs 52-54 of the second multi-chip LED unit 5 in the first diode row.

The multi-chip LED array further includes a second diode row. The second diode row includes the third multi-chip LED unit 4' and the fourth multi-chip LED unit 5' each mounted on the base plate 2. The third multi-chip LED unit 4' includes a red LED 42, a green LED 43, and a blue LED 44, as well as a third transparent lens 45'. The fourth multi-chip LED unit 5' includes a red LED 52, a green LED 53, and a blue LED 54, as well as a fourth transparent lens 55'. Emitted light of each of the red, green, and blue LEDs 42-44, 52-54 of the third and fourth multi-chip LED units 4', 5' has a respective primary emission direction along which a majority of the emitted light is projected through a corresponding one of the third and fourth transparent lenses 45', 55'.

The primary emission directions of the red, green, and blue LEDs 42-44 of the third multi-chip LED unit 4' in the second diode row are oriented in opposite directions respectively as compared to the primary emission directions of the red, green, and blue LEDs 42-44 of the first multi-chip LED unit 4 in the first diode row. Furthermore, the primary emission directions of the red, green, and blue LEDs 52-54 of the fourth multi-chip LED unit 5' in the second diode row are oriented in opposite directions respectively as compared to the primary emission directions of the red, green, and blue LEDs 52-54 of the second multi-chip LED unit 5 in the first diode row.

In the preferred embodiment, the first diode row includes a plurality of the first multi-chip LED units 4 and a plurality of the second multi-chip LED units 5, and the first and second multi-chip LED units 4, 5 are alternately arranged within the first diode row. Similarly, the second diode row includes a plurality of the third multi-chip LED units 4' and a plurality of the fourth multi-chip LED units 5', and the third and fourth multi-chip LED units 4', 5' are alternately arranged within the second diode row.

Furthermore, in the preferred embodiment, the multi-chip LED array includes a plurality of the first diode rows and a plurality of the second diode rows, in which the first and second diode rows are alternately disposed on the base plate 2. The rows may form columns of aligned first and third multi-chip LED units 4, 4' and aligned second and fourth multi-chip LED units 5, 5'.

The red, green, and blue LEDs 42-44 and 52-54 of each of the first and third multi-chip LED units 4, 4', and the red, green, and blue LEDs 52-54 of each of the second and fourth multi-chip LED units 5, 5' are disposed to form the shape of an isosceles triangle. The red, green, and blue LEDs 42-44, 52-54 of the first and second multi-chip LED units 4, 5 that emit light with their primary emission directions oriented along the first direction 7 are positioned at apexes of the corresponding isosceles triangles. In FIGS. 3 and 4, the red LEDs 42, 52 are shown at the apexes of the corresponding isosceles triangles of the first and second multi-chip LED units 4,5. However, the present invention is not limited in this respect, and either the green LEDs 43, 53 or the blue LEDs 44, 54 may be positioned at the apexes of the corresponding isosceles triangles.

Since the primary emission directions of the red, green, and blue LEDs 42-44 of the third multi-chip LED unit 4' in the second diode row are oriented in opposite directions respectively as compared to the primary emission directions of the red, green, and blue LEDs 42-44 of the first multi-chip LED unit 4 in the first diode row, and since the primary emission directions of the red, green, and blue LEDs 52-54 of the fourth multi-chip LED unit 5' in the second diode row are oriented in opposite directions respectively as compared to the primary emission directions of the red, green, and blue LEDs 52-54 of the second multi-chip LED unit 5 in the first diode row, it follows that each of the particular ones of the red, green, and blue LEDs 42-44, 52-54 of the third and fourth multi-chip LED units 4', 5' positioned at the apex of the corresponding isosceles triangle emits light with its primary emission direction oriented opposite to the first direction 7.

In this embodiment, taking into account the positions of the green and blue LEDs 43, 44, 53, 54 with respect to the red LEDs 42, 52, the first and third multi-chip LED units 4(4') can be classified as first-type multi-chip LED units, while the second and fourth multi-chip LED units 5(5') can be classified as second-type multi-chip LED units.

As shown in FIG. 3, each of the first through fourth transparent lenses 45, 45', 55, 55' is a rounded symmetrical lens. In addition, each of the first through fourth multi-chip LED units 4, 4', 5, 5' includes a seat 41, 51 on which the corresponding ones of the red, green, and blue LEDs 42-44, 52-54 are mounted. A center axis 451 of each of the first and third transparent lenses 45, 45' passes through a center point among the red, green, and blue LEDs 42-44 of the corresponding one of the first and third multi-chip LED units 4, 4'. Similarly, a center axis 551 of each of the second and fourth transparent lenses 55, 55' passes through a center point among the red, green, and blue LEDs 52-54 of the corresponding one of the second and fourth multi-chip LED units 5, 5'. The primary emission directions of the red, green, and blue LEDs 42-44, 52-54 of each of the first through fourth multi-chip LED units 4, 4', 5, 5' are skewed relative to the center axis of the corresponding one of the first through fourth transparent lenses 45, 45', 55, 55'.

As shown in FIG. 5, the base plate 2 and the first through fourth multi-chip LED units 4, 4', 5, 5' are mounted in the housing 3. Further, the diffusion sheet 6 is mounted to the housing 3 such that the emitted light of the red, green, and blue LEDs 42-44, 52-54 of the first through fourth multi-chip LED units 4, 4', 5, 5' passes through the diffusion sheet 6. The diffusion sheet 6 scatters and uniformly diffuses light that passed through the transparent lenses 45, 45', 55, 55'.

The illumination assembly of the present invention has many advantages over the conventional configurations described hereinabove. For example, the light emitted from any one of the LEDs 42-44, 52-54 is not directed straight toward the light of an identically colored one of the LEDs 42-44, 52-54 of an adjacent one of the first through fourth multi-chip LED units 4, 4', 5, 5' (i.e., their primary emission directions do not collide head-on), nor does such light strike the same position on the diffusion sheet 6. This optimizes the color additive effect and hence the purity of the obtained white light, and, in addition, reduces the color combination distance.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An illumination assembly, comprising:

a base plate; and a multi-chip light emitting diode (LED) array comprising a first diode row including a first multi-chip LED unit and a second multi-chip LED unit each mounted on said base plate, said first multi-chip LED unit including a red LED, a green LED, a blue LED, and a first transparent lens, said second multi-chip LED unit including a red LED, a green LED, a blue LED, and a second transparent lens, emitted light of each of said red, green, and blue LEDs of said first and second multi-chip LED units having a respective primary emission direction along which a majority of the emitted light is projected through a corresponding one of said first and second transparent lenses, the primary emission directions of one of said red, green, and blue LEDs of said first multi-chip LED unit and of the same one of said red, green, and blue LEDs of said second multi-chip LED unit being oriented along a first direction in said first diode row, the primary emission directions of the remaining two of said red, green, and blue LEDs of said first multi-chip LED unit being in a reversed order of the primary emission directions of the same remaining two of said red, green, and blue LEDs of said second multi-chip LED unit in said first diode row.

2. The illumination assembly of claim 1, wherein said multi-chip LED array further comprises a second diode row including a third multi-chip LED unit and a fourth multi-chip LED unit each mounted on said base plate, said third multi-chip LED unit including a red LED, a green LED, a blue LED, and a third transparent lens, said fourth multi-chip LED unit including a red LED, a green LED, a blue LED, and a fourth transparent lens, emitted light of each of said red, green, and blue LEDs of said third and fourth multi-chip LED units having a respective primary emission direction along which a majority of the emitted light is projected through a corresponding one of said third and fourth transparent lenses, the primary emission directions of said red, green, and blue LEDs of said third multi-chip LED unit in said second diode row being oriented in opposite directions respectively as compared to the primary emission directions of said red, green, and blue LEDs of said first multi-chip LED unit in said first diode row, the primary emission directions of said red, green, and blue LEDs of said fourth multi-chip LED unit in said second diode row being oriented in opposite directions respectively as compared to the primary emission directions of said red, green, and blue LEDs of said second multi-chip LED unit in said first diode row.

3. The illumination assembly of claim 2, wherein said first diode row includes a plurality of said first multi-chip LED units and a plurality of said second multi-chip LED units, said first and second multi-chip LED units being alternately arranged within said first diode row.

4. The illumination assembly array of claim 3, wherein said second diode row includes a plurality of said third multi-chip LED units and a plurality of said fourth multi-chip LED units, said third and fourth multi-chip LED units being alternately arranged within said second diode row.

5. The illumination assembly of claim 4, wherein said multi-chip LED array comprises a plurality of said first diode rows and a plurality of said second diode rows, said first and second diode rows being alternately disposed on said base plate.

6. The illumination assembly of claim 1, wherein said red, green, and blue LEDs of each of said first and second multi-chip LED units are disposed to form the shape of an isosceles triangle.

7. The illumination assembly of claim 6, wherein said ones of said red, green, and blue LEDs of said first and second multi-chip LED units that emit light with their primary emission directions oriented along said first direction are positioned at apexes of the corresponding isosceles triangles.

8. The illumination assembly of claim 1, wherein each of said first and second transparent lenses is a rounded symmetrical lens.

9. The illumination assembly of claim 1, wherein the red, green, and blue LEDs of each of said first and second multi-chip LED units are disposed to form the shape of a triangle, and a center axis of each of said first and second transparent lenses passes through a center point among said red, green, and blue LEDs of the corresponding one of said first and second multi-chip LED units.

10. The illumination assembly of claim 1, wherein the primary emission directions of said red, green, and blue LEDs of each of said first and second multi-chip LED units are skewed relative to a center axis of the corresponding one of said first and second transparent lenses.

11. The illumination assembly of claim 1, further comprising:

a housing in which said base plate and said first and second multi-chip LED units are mounted; and a diffusion sheet mounted to said housing such that the emitted light of each of said red, green, and blue LEDs of said first and second multi-chip LED units passes through said diffusion sheet.

12. The illumination assembly of claim 1, wherein each of said first and second multi-chip LED units includes a seat on which the corresponding ones of said red, green, and blue LEDs are mounted.

13. An illumination assembly, comprising:

a base plate; and a multi-chip light emitting diode (LED) array comprising a first diode column including a first multi-chip LED unit and a third multi-chip LED unit, each of said first and third multi-chip LED units including a red LED, a green LED, and a blue LED, said first and third multi-chip LED units further including a first transparent lens and a third transparent lens, respectively, emitted light of each of said red, green, and blue LEDs of said first and third multi-chip LED units having a respective primary emission direction along which a majority of the emitted light is projected through a corresponding one of said first and third transparent lenses, the primary emission directions of said red, green, and blue LEDs of said third multi-chip LED unit being oriented in opposite directions respectively as compared to the primary emission directions of said red, green, and blue LEDs of said first multi-chip LED unit.

14. The illumination assembly of claim 13, wherein said multi-chip LED array further comprises a second diode column including a second multi-chip LED unit and a fourth multi-chip LED unit, each of said second and fourth multi-chip LED units including a red LED, a green LED, and a blue LED, said second and fourth multi-chip LED units further including a second transparent lens and a fourth transparent lens, respectively, emitted light of each of said red, green, and blue LEDs of said second and fourth multi-chip LED units having a respective primary emission direction along which a majority of the emitted light is projected through a corresponding one of said second and fourth transparent lenses, the primary emission directions of said red, green, and blue LEDs of said fourth multi-chip LED unit being oriented in opposite directions respectively as compared to the primary emission directions of said red, green, and blue LEDs of said second multi-chip LED unit, the primary emission directions of one of said red, green, and blue LEDs of said first multi-chip LED unit and of the same one of said red, green, and blue LEDs of said second multi-chip LED unit being oriented along a first direction, the primary emission directions of the remaining two of said red, green, and blue LEDs of said first multi-chip LED unit being in a reversed order of the primary emission directions of the same remaining two of said red, green, and blue LEDs of said second multi-chip LED unit.

15. The illumination assembly of claim 14, wherein said first diode column includes a plurality of said first multi-chip LED units and a plurality of said third multi-chip LED units, said first and third multi-chip LED units being alternately arranged within said first diode column.

16. The illumination assembly of claim 15, wherein said second diode column includes a plurality of said second multi-chip LED units and a plurality of said fourth multi-chip LED units, said second and fourth multi-chip LED units being alternately arranged within said second diode column.

17. An illumination assembly, comprising:

a base plate; and a multi-chip light emitting diode (LED) array comprising:

a plurality of first-type multi-chip LED units each mounted on said base plate, each of said first-type multi-chip LED units including a red LED, a green LED, and a blue LED, and further including a first transparent lens, emitted light of each of said red, green, and blue LEDs of said first-type multi-chip LED units having a respective primary emission direction along which a majority of the emitted light is projected through a corresponding one of said first transparent lenses; and a plurality of second-type multi-chip LED units each mounted on said base plate, each of said second-type multi-chip LED units including a red LED, a green LED, and a blue LED, and further including a second transparent lens, emitted light of each of said red, green, and blue LEDs of said second-type multi-chip LED units having a respective primary emission direction along which a majority of the emitted light is projected through a corresponding one of said second transparent lenses, said first-type and second-type multi-chip LED units being arranged on said base plate in a matrix of substantially aligned diode columns and diode rows, said first-type and second-type multi-chip LED units being alternately arranged within each diode row of said matrix, the primary emission direction of one of said red, green, and blue LEDs of each said first-type multi-chip LED unit and of the same one of said red, green, and blue LEDs of each said second-type multi-chip LED unit being oriented along a first direction for a first diode row of said first-type and second-type multi-chip LED units, the primary emission directions of the remaining two of said red, green, and blue LEDs of each said first-type multi-chip LED unit being in a reversed order of the primary emission directions of the same remaining two of said red, green, and blue LEDs of each said second-type multi-chip LED unit in said first diode row of said first-type and second-type multi-chip LED units, the primary emission directions of said red, green, and blue LEDs of each said first-type multi-chip LED unit in a second diode row adjacent to said first diode row of said first-type and second-type multi-chip LED units being oriented in opposite directions respectively as compared to the primary emission directions of said red, green, and blue LEDs of each said first-type multi-chip LED unit in said first diode row, the primary emission directions of said red, green, and blue LEDs of each said second-type multi-chip LED unit in said second diode row of said first-type and second-type multi-chip LED units being oriented in opposite directions respectively as compared to the primary emission directions of said red, green, and blue LEDs of each said second-type multi-chip LED unit in said first diode row.

* * * * *